US005562227A

United States Patent [19]

Takezawa et al.

[11] Patent Number: 5,562,227

[45] Date of Patent: Oct. 8, 1996

[54] ANTI-BULGING BAG-IN-BOX

[75] Inventors: Taihei Takezawa; Hyozaemon Takanashi, both of Noda; Nobuo Sugimaru, Tokyo; Shoichi Kawase, Tokyo; Yutaka Watanabe, Tokyo; Mitsuo Takayanagi, Tokyo; Kinzaburo Akita, Noda, all of Japan

[73] Assignees: Honshu Paper Co., Ltd., Tokyo; Kikkoman Corporation, Chiba-ken, both of Japan

[21] Appl. No.: 509,355

[22] Filed: Jul. 31, 1995

[51] Int. Cl.[6] ..... B65D 5/42; B65D 5/60

[52] U.S. Cl. ..... 220/403; 220/441; 220/462; 229/191; 229/918

[58] Field of Search ..... 229/191, 918; 220/403, 410, 416, 462, 463, 441

[56] References Cited

U.S. PATENT DOCUMENTS

| | | | |
|---|---|---|---|
| 1,653,116 | 12/1927 | Parks | 229/191 |
| 3,752,301 | 8/1973 | Bluemel | 220/441 |
| 4,056,223 | 11/1977 | Williams . | |
| 4,623,075 | 11/1986 | Riley | 220/462 |
| 4,706,809 | 11/1987 | Halsell | 220/441 |
| 4,919,306 | 4/1990 | Heaps, Jr. et al. | 220/462 |
| 5,069,359 | 12/1991 | Liebel | 220/462 |
| 5,294,044 | 3/1994 | Clark | 229/191 |
| 5,407,090 | 4/1995 | Boots | 220/403 |
| 5,452,848 | 9/1995 | Mur Gimeno | 229/191 |
| 5,458,283 | 10/1995 | Southwell et al. | 229/191 |

FOREIGN PATENT DOCUMENTS 462615 5/1992 Japan .

OTHER PUBLICATIONS

Japan Package Institute, Announcement of Kinoshita Prize award, Apr. 20, 1994, all pages.

Packaging Technology of Aug. 1994, vol. 32, No. 8, published by the Japan Packaging Institute; Special Edition :A Utility View of Corrugated Fibreboard Packaging—New Corrugated Fibreboard Structure Prevents Bulging—The Super Bib "OCTO Post", written by Taihei Takezawa, Mitsuo Takayanagi, and Shoichi Kawase.

Color catalog of "OCTO Post" (showing prior art article and present inventive article).

*Primary Examiner*—Gary E. Elkins

*Attorney, Agent, or Firm*—Morrison Law Firm

[57] ABSTRACT

To provide a packaging container with anti-bulging function comprising a bag inside a box in which an inner bag is set in an octangular inner cylinder integrated with a quadrangular outer casing. The bag inside the box provides an anti-bulging function to prevent the outer casing from bulging, by developing a counter bulge in the inner bag acting on an oblique surface of the octangular inner cylinder to pull a side wall of the quadrangular outer casing inward.

18 Claims, 13 Drawing Sheets

PRIOR ART

PRIOR ART

ANTI-BULGING BAG-IN-BOX

BACKGROUND OF THE INVENTION

The present invention relates to a bag-in-box container for storing and carrying liquid or fine particles (with hereafter generally be named flowable products). More particularly the present invention relates to a bag-in-box container in which a casing is resistant to bulging due to a bulging inner bag.

A composite packaging container of a corrugated fiberboard box with a flexible plastic inner liner is known in the art. These disposable containers are used for storing and dispensing. For Example seasonings such as soy sauce, vinegar, food additives, beverages such as liquor and mineral water, or chemicals such as liquid developer, liquid fertilizer, adhesive and detergent. This composite packaging container is generally called a "bag-in-box".

The bag-in-box is issued to contain or shaped flowable products. These products exert internal pressure of the content directly to the side panel of the container. This internal pressure exerts a local concentration of stress which causes container to bulge or buckle The problem is exaggerated, when the box absorbs moisture while containers are piled up and stored. The result is that the containers overturn or the merchandise value is lowered.

Often, the containers are prevented from collapsing by decreasing the number of stages of piled-up containers. However, this is disliked by distributors. Alternatively, the container is made to withstand the internal pressure by decreasing its relative size.

For these reasons metallic containers having high rigidity such as cans remain preferable as liquid transportation containers.

However, though the metallic container are strong. They are also heavier and more difficult to recollect after use. Additionally, they require extra storage space when empty, cannot be folded, and have a higher transportation cost.

In contrast, the bag-in-box is lightweight because it uses a corrugated fiberboard box as its outer package and a thin-walled container made of flexible plastic or a bag as its inner package. Consequently, the transportation cost, the warehouse cost, and the distribution costs are diminished. Moreover, it is disposable and unnecessary to recollect the box after it becomes empty. After use, after the box is used, the outer package can be recycled as pulp resource and the relatively small plastic container serving as the inner package can easily be. Therefore, the bag-in-box has advantages that the labor and energy can be saved and the costs can be reduced. To date, a bag-in-box which, does not exhibit bulging has not been reported.

To prevent the bag-in-box from bulging, it is necessary to increase the strength of the side panel. Therefore, it is preferred to form the box by using double wall corrugated fiberboard or triple wall corrugated fiberboard and decease the height of the box. To reinforce the side panel of the box, there is an existing method of arranging a piece of corrugated fiberboard called a sleeve folded like a cylinder inside of the box.

However, by only inserting the sleeve made of a material different from that of the casing into the box, it is impossible to prevent the casing from bulging due to a bulged bag storing liquid. Moreover, this method is inferior in profitability and packaging characteristic including materials because the casing comprises a plurality of pieces. Therefore, this method is significantly limiting.

As another means for reinforcing the side panel of the box, it is attempted to use a Bliss type box. However, even the Bliss type box has problems that the box structure becomes complex, the productivity lowers, and the cost rises.

Moreover, a relatively small carton is known in which a reinforcement member approximately Z-folded is set to the center between faced side panels in order to prevent bulging. Though this carton is effective to store fine particles or a small solid material, it cannot be applied to a large bag-in-box for storing bags containing liquid.

As for a box, it is generally known that the bending strength of the side panel of the box or the compressive strength of the whole box is improved when a number of angles are formed by bending the material (corrugated fiberboard or paperboard sheet blank) of the side panel of the box. By using the above theory, a container is proposed which is constituted by extending a flap to the both ends of faced side panels of the box respectively and folding the flap toward the inside of a corner of the box and bonding it to the corner in order to reinforce the four corners of the box. (Refer to U.S. Pat. No. 4,056,223.)

The container disclosed in the above U.S. patent (be sure to refer to the enclosed U.S. Pat. No. 4,056,223) is a container for storing packaged cut meat, having a structure in which four connected corner reinforcement members 121*a* through 121*d* and 122*a* to 122*d* are bonded to the both sides of side panels 116 and 117 so as to form a triangular space between the adjacent side panels 113 and 114 and thereby form a triangular cylindrical reinforcement column P inside of each corner of the box as shown in FIG. 15. Prior art This patent publication contemplates reinforcing the four corners of the box to improve the overall strength i.e., buckling strength, of the underlying box, such as when during transportation. For purposes of reinforcing the four corners of the box, flaps 121*a* through 121*d*, 122*a* through 122*d* are extended to both ends of the faced side of the panels of the box and folded to bond to the inside of the box corner.

However, the box embraced by this prior art invention fails to teach or suggest the bag-in-box concept of the present invention. Also, this publication is devoid of any teaching suggesting the side panel of the container itself or the novel way in which the presently contemplated box-in-bag is able to minimize bulging due to internal pressure imparted by the content of the container.

Indeed, it is a feature of the present invention that casing of the bag-in-box is such that an oblique surface of the octagonal inner cylinder exerts a pulling effect on the side panel of the quadrangular casing inward, thus preventing bulging of the box. The present invention aims to minimize bulging wherein the construction of the bag satisfies the formula Lp<alpha p or beta p in cases where the stress is internal pressure of the oblique surface of the octangular inner cylinder as Lp and the stress of the internal to internal pressure of the fixed surface between the inner cylinders and the side panel of the casing as alpha p or beta p. In the present invention, it is advantageous that the bag-in-box is provided to prevent protruding corners from being formed in the box so as to form the inner bag prevented from being broken due to contact with the corner. In this case, however, a stepped portion with a thickness equivalent to the thickness of one or two material sheets is produced in the inner surface of the container. The stepped-portion appears as a right- or an acute-angle corner when observing the cross section of the container. Therefore, when the above container is used as, for example, the outer package of the bag-in-box for storing liquid and an inner bag B made of flexible plastic is set in the container, the surface of the plastic inner bag B tends to be scratched due to the angles of the container inside as shown in FIG. 16 which shows a prior art bag. Moreover, in the case of a liquid transportation container, liquid easily causes rocking splash due to vibrations and shocks during transportation. When rocking occurs, the plastic inner bag B moves as shown by a chain line in FIG. 16. A film forming the bag receives a repetitive bending force due to rocking, the bag is deformed and contacts the wall surface of the container, and resultantly, the bag is easily broken. When the bag is rubbed on a corner or receives a repetitive modified bending force, a pin hole may easily be produced on the bag due to at least one of the factors. When the pin hole is produced, the liquid tends to leak.

OBJECTS AND SUMMARY OF THE INVENTION

It is an object of the present invention to provide a bag-in-box for storing and packaging a flowable product such as liquid, which is a new-type corrugated fiberboard box preventing a casing from bulging due to a bulged inner bag when the box is used.

It is another object of the present invention to provide the bag-in-box casing having a one-piece structure and a built-in octagonal inner cylinder. The octagonal inner cylinder prevents the casing from bulging.

Briefly, the casing of the present invention is the bag-in-box casing in which an inner bag is arranged inside of the octagonal inner cylinder integrated with the quadrangular casing. The bag-in-box casing is a casing in which an oblique surface of the octagonal inner cylinder pulls the side panel of the quadrangular casing inward so that bulging does not occur.

The present invention comtemplates an anti-bulging bag-in-box comprising a sheet blank made of a piece of corrugated fiberboard or a piece of paperboard sheet blank and provided with a rectangular bottom plate, two pairs of faced side panels erected at four sides of the bottom plate, the quadrangular casing formed by extending a lid to each top margin of the two pairs of side panels, an inner cylinder whose horizontal cross section is almost octangular, and a bag made of a flexible material or a thin-walled container; wherein the octangular inner cylinder is formed by four inner-cylinder forming pieces connected to the both sides of either of the two pairs of side panels, the inner-cylinder forming pieces are formed into an octangular cylinder by folding them inside of the casing through folds formed between the inner-cylinder forming pieces, and a bag or thin-walled container with a dimension larger than the inside diameter of the octangular inner cylinder is arranged inside of the cylinder (refer to claim 1).

Moreover, the present invention provides a anti-bulging bag-in-box having the relation of $LO>\alpha$ or $\beta$ when assuming the length of an oblique surface of the octangular inner cylinder as LO and the length of the fixed surface between the inner cylinder and the side panel of the casing as $\alpha$ or $\beta$ Furthermore, the present invention is the bag-in-box having the relation of $Lp<\alpha$ p or $\beta$ p when assuming the stress to internal pressure of the oblique surface of the octangular inner cylinder as Lp and the stress to internal pressure of the fixed surface between the inner cylinder and the side panel of the casing as $\alpha$ p or $\beta$ p.

Furthermore, the present invention is an anti-bulging bag-in-box having a fold for decreasing the strength almost at the center of an oblique surface of the octangular inner cylinder in the depth direction.

It is still another object of the present invention to provide a bag-in-box preventing a stepped portion from being formed in a box due to a material (corrugated fiberboard or paperboard sheet blank) forming the box and preventing an inner bag or a thin-walled container from being broken due to contact with the stepped portion.

That is, the present invention is an anti-bulging bag-in-box having a structure in which ends of the inner-cylinder forming pieces are butted each other so that a gap or stepped portion is not formed between the ends of the inner-cylinder forming pieces connected to be adjoined each other on the inner surface of each side panel (refer to claim 4).

Other objects, features, and advantages of the present invention will become more apparent from the accompanying drawings and the detailed description to be mentioned later.

DETAILED DESCRIPTION OF THE INVENTION

Figure 1:
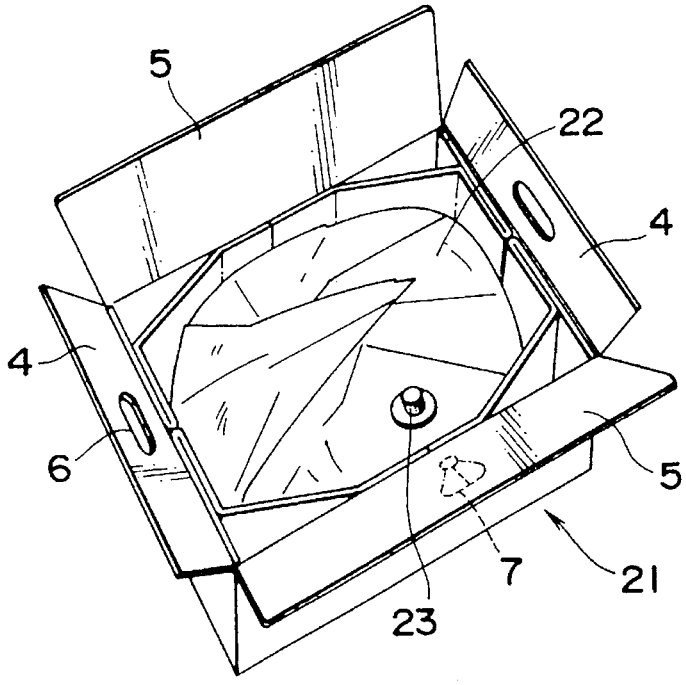
FIG. 1 is a perspective view showing the bag-in-box of an embodiment of the present invention, in which the top panel of a casing is removed to expose an inner bag.

The various embodiments of present invention is concretely described below by referring to the accompanying drawings. In the drawings, the same symbol is used for the same portion.

Figure 5:
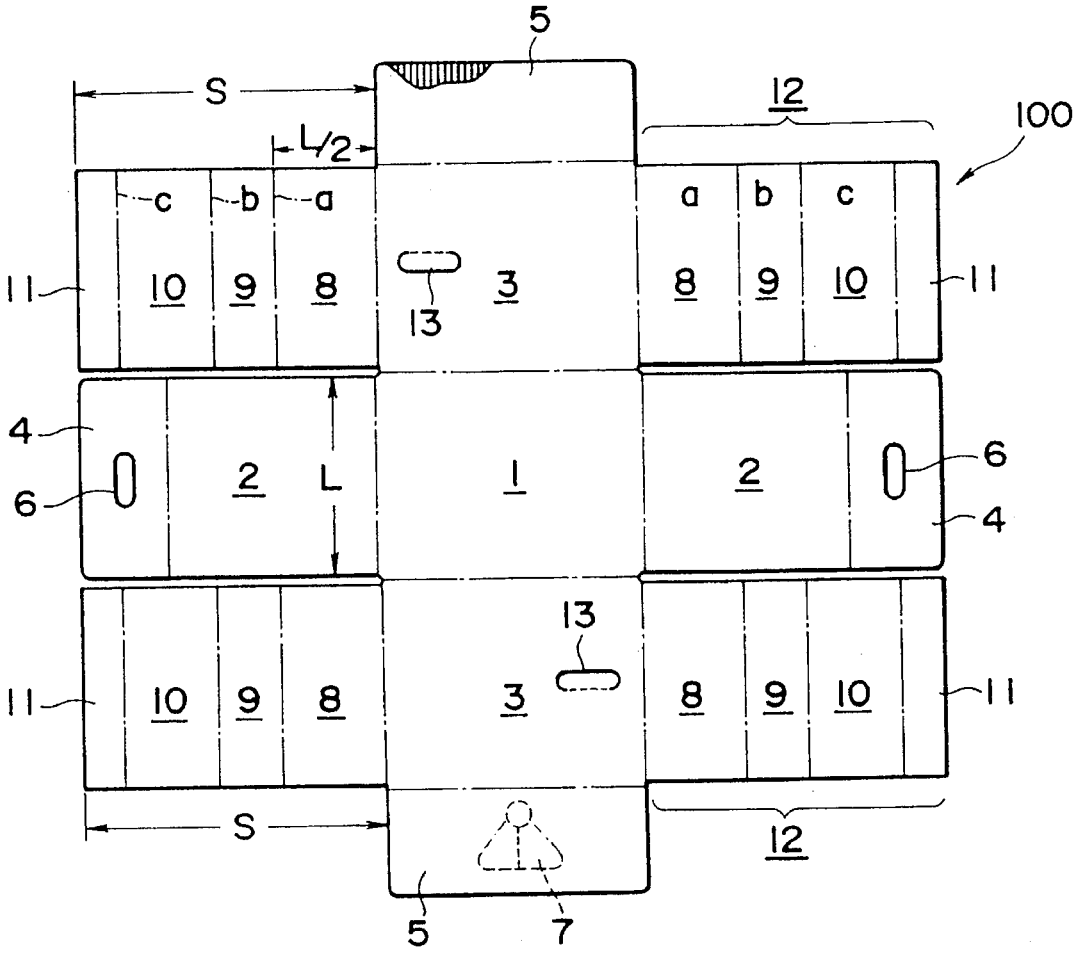
FIG. 5 is a developed top view showing a sheet blank constituting the casing.

Referring to FIG. 5, there is shown a casing used according to an embodiment of the present invention, a rectangular bottom plate is formed almost at the center of a sheet blank 100 made of cardboard such as single-wall corrugated fiberboard or paperboard as shown in FIG. 5. Two pairs of side panels 2 and 3 are formed at four sides of the bottom plate and an extended flap 12 is connected with the both sides of either of the two pairs of side panels.

In FIG. 5, symbol 1 represents a rectangular bottom plate partitioned by a fold formed into a quadrangle almost at the center of the blank 100, 2 and 2 represent a pair of side panels connected with the right and left sides of the bottom plate i through a fold, and 3 and 3 represent a pair of side panels connected with the front and rear sides of the bottom plate 1 through a polygonal line. The side panels 3 and 3 are formed so that they are wider than the side panels 2 and 2. Other ends of the side panels 2 and 2 and 3 and 3 connect with inner flaps 4 and 4 and outer flaps 5 and 5 serving as lids when the box is assembled and used. Symbol 6 represents a disassembling hand hole formed on one inner flap 4. Symbol 7 represents a fixed hole serving as a spout formed on an inner bag partitioned and formed by cutting perforations.

The casing of the present invention is provided with the extended flaps 12 and 12 having the length S obtained by extending the right and left ends of the wider side panels 3 and 3 and adding the side panel 2 and an inner flap. Four inner-cylinder forming pieces 8 to 11 are partitioned and formed on each extended flap 12 through parallel folds a to c respectively. The inner-cylinder forming piece 8 adjacent to the side panel 3 is formed so that the width is half the width L of the side panel 2. Symbol 13 represents a hand hole formed on the faced side panels 3 and 3 respectively, which is deviated to the right or left from the center line of the box and located almost at the diagonal position as described later.

The casing of the present invention formed with one blank 100 is assembled by hand or machine as described below.

Figure 3:
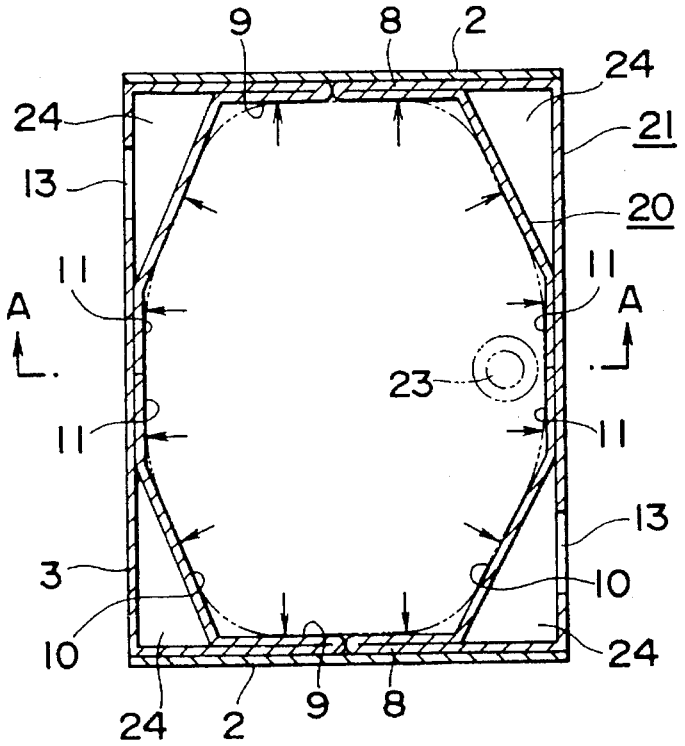
FIG. 3 is a horizontal sectional view of the casing.

First, the inner-cylinder forming piece 8 is integrated with the inside of the adjacent side panel 2 while erecting the side panels 2 and 2 and 3 and 3 perpendicularly to the bottom plate 1. Then, through a fold "a" formed between the inner-cylinder forming pieces 8 and 9, the inner-cylinder forming piece 9 is superimposed on the inner-cylinder forming piece 8 by folding it up to 180 deg., and in the inside of the side panel 2, the adjacent inner-cylinder forming pieces 8 and 8 and 9 and 9 are butted and joined each other so that any gap is not produced, and the outermost inner-cylinder forming piece 11 is integrated with the inside of the wider side panel 3. In this case, the ends of the inner-cylinder forming pieces 11 and 11 adjacent in the inside of the side panel 3 are butted and joined each other so that any stepped portion or gap is not produced between them (a horizontal profile of the joined pieces 11 and 11 is shown in FIG. 3).

Figure 9:
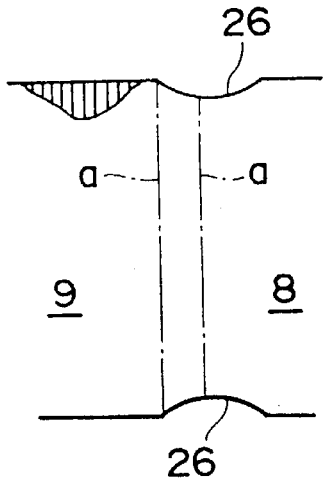
FIG. 9 is an enlarge view of the circular-arc recess in FIG. 8.

When the casing and inner cylinder of the present invention are folded and formed by a sheet blank made of corrugated fiberboard, a fold called a crease parallel with a flute of the sheet blank is previously formed. However, because the fold is formed at the flute tip or flute bottom of corrugated fiberboard, or the middle between the flute tip and flute bottom at random, the sheet blank may not be folded at a predetermined position. Therefore, the shape of an assembled casing and inner cylinder or their folded dimensions may change. This tendency remarkably appears when folding a blank up to 180 deg. and therefore, the folding accuracy lowers. When the folding accuracy lowers, the ends of the inner-cylinder forming pieces 8 and 9 are not preferably butted to cause a bag to be broken. The problem that the sheet blank made of corrugated fiberboard is not folded at a predetermined position can be solved by forming two parallel folds "a" for 180 deg. between the inner cylinder forming pieces 8 and 9 folding at an interval of 5 or 6 mm and forming a circular-arc recess 26 for concentrating a bending stress on the both ends of each fold "a" when folding the sheet blank (refer to FIG. 9).

Figure 2:
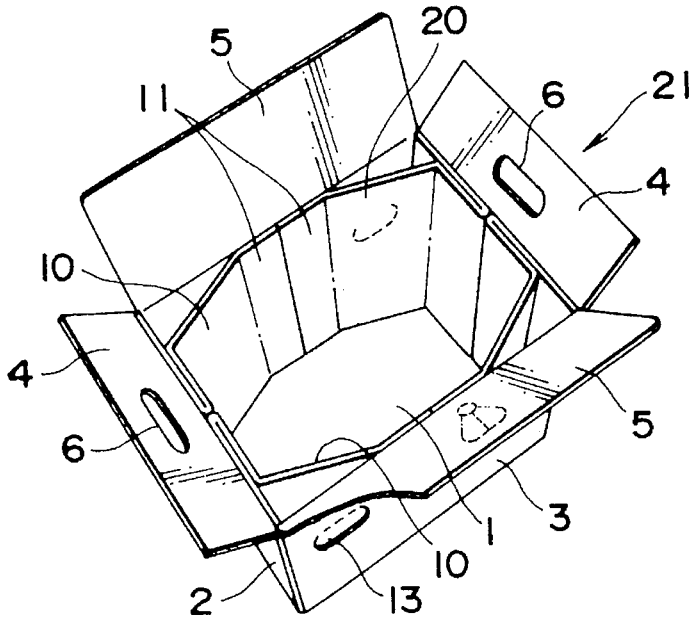
FIG. 2 is a perspective view of only the casing with the inner bag removed from the bag-in-box in FIG. 1, showing the state in which an octangular inner cylinder is integrated with the inside of a quadrangular casing.

Thus, a bag-in-box casing is obtained in which an octangular inner cylinder 20 is integrated with the inside of a quadrangular casing 21 (refer to FIG. 2). This box has a one-piece structure in which the quadrangular casing and the octangular inner cylinder can be formed with one sheet blank made of cardboard such as corrugated fiberboard by folding the sheet blank. Moreover, an oblique surface (inner-cylinder forming piece 10) of the inner cylinder 20 is diagonally set to four corners of the quadrangular casing 21 in the above octangle.

FIG. 1 shows the state in which an inner bag 22 is set to the inside of the octangular inner cylinder 20. The inner bag 22 is made of a flexible plastic film using polyethylene or nylon or a laminate film mainly using polyethylene and nylon and provided with a spout 23 at one end of the bag. To discharge the content liquid out of the inner bag set in the casing or take it out of the bag in small quantities, a partitioned and formed cutting perforation 7 is formed on the above-described outer flap 5 to secure the spout 23 there.

Figure 4:
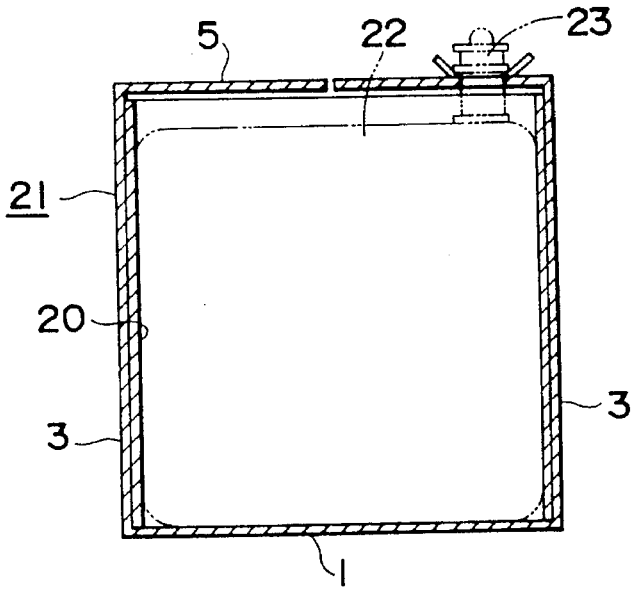
FIG. 4 is a vertical sectional view of the casing, showing the state in which a lid is closed.

FIG. 4 shows the state in which the inner bag 22 shown by a chain line is set to the casing and thereafter, the top panel of the box is closed by a lid comprising the inner flaps 4 and 4 and outer flaps 5 and 5.

Figure 7:
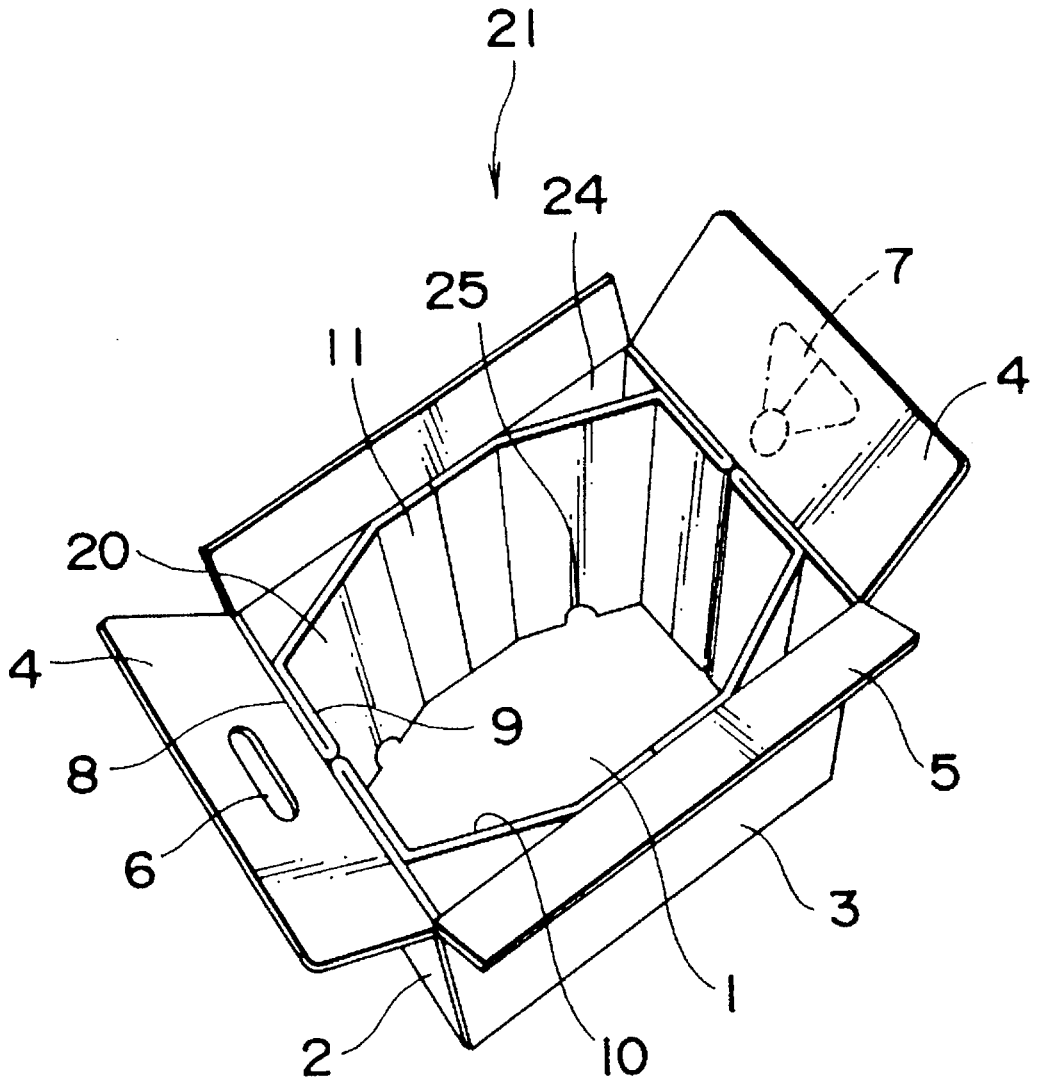
FIG. 7 is a perspective view of the casing with an air vent hole formed on the inner cylinder.
Figure 8:
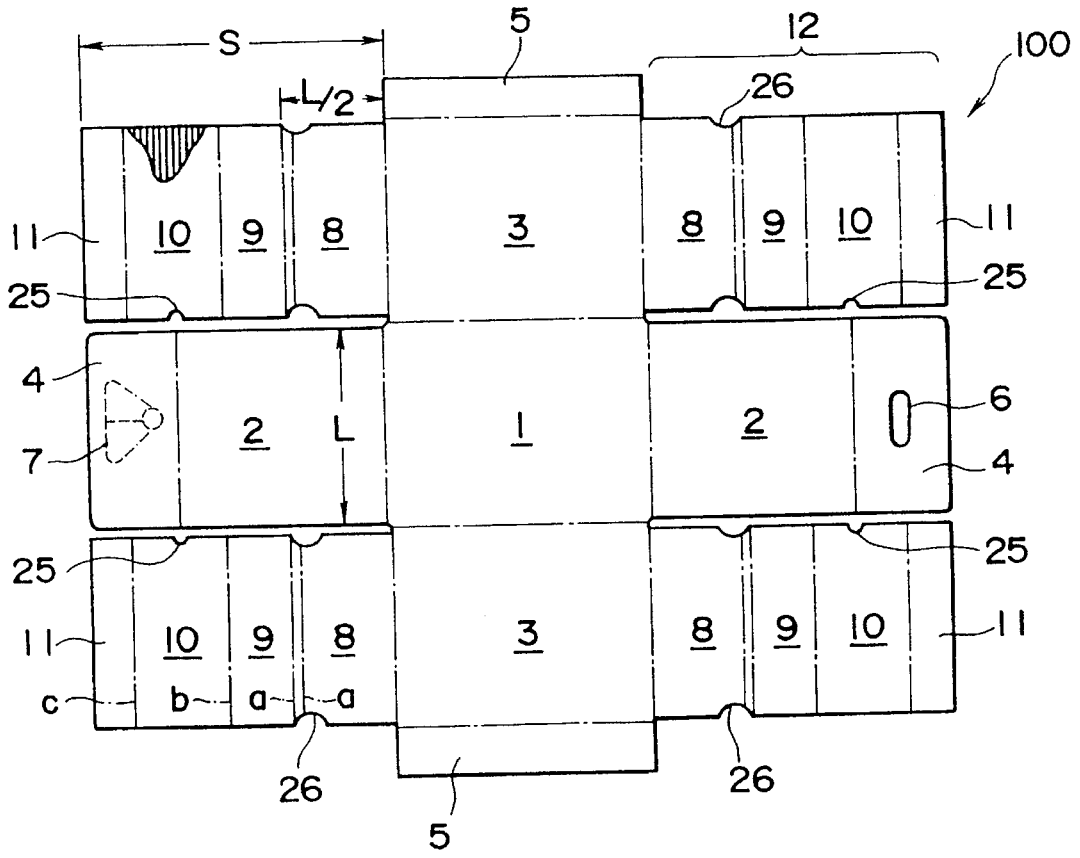
FIG. 8 is a developed top view of the casing in FIG. 7, showing the state in which a 180 deg. bending parallel fold is formed on the inner-cylinder piece and a circular-arc recess is formed at the both ends of the fold.

When inserting the inner bag 22 filled with the content into the casing 21, however, a trouble may occur that the air remaining in the box prevents the inner bag from dropping and thereby the inner bag stops midway and thus, the inner bag cannot be inserted up to the bottom. This is because, when inserting the inner bag into the casing, the inner bag closes the opening of the box and thereby, air is not released from the opening. Therefore, it is necessary to increase the dimensions of the casing. However, if the casing dimensions are increased, an unnecessary space is formed at the bottom or top of the bag. This is not preferable for transportation, storage, or sale. The above trouble can be settled by forming one or more air vent holes 25 extending up to a triangular space 24 between the casing and the octangular inner cylinder under the oblique surface of the inner cylinder (refer to FIGS. 7 and 8). That is, when inserting the inner bag into the inside of the inner cylinder, the air in the box is released to the outside from the inside bottom of the oblique surface of the inner cylinder through the triangular space 24 between the casing and the inner cylinder. Even if the inner bag has a dimension equal to or larger than the inside diameter of the inner cylinder, the inner bag smoothly drops to the bottom of the casing while deforming and fitting to the inside of the inner cylinder. Therefore, it is easily inserted into the inside of the inner cylinder.

The shape of the air vent hole 25 can be any convenient shape as, for example circular, triangular, or quadrangular. As another example, the hole 25 can be a slit.

It is preferable to form the hand hole 13 outside of the triangular space 24 formed between a faced side panel of the casing 21 and the inner cylinder 20 on the faced side panel, that is, at the diagonal position of the box.

Functions and advantages of the bag-in-box of the present invention are described below.

The bag-in-box casing of the present invention is formed by combining the quadrangular box 21 and the octangular inner cylinder 20. Because the box and the inner cylinder are integrated each other, a corner of the box has a very high compressive strength and therefore, the box is hardly deformed even if a compressive load or shearing load is applied to the box from the vertical, horizontal, or diagonal direction.

Because the inner cylinder set in the inside of the casing is octangular the internal pressure due to the bulged inner bag set in the inner cylinder works outward against the inside of the inner cylinder (refer to the arrow in FIG. 3).

The internal pressure is applied to the side panel 2 or 3 outward (bulging direction) through the inner cylinder. At the same time, the internal pressure causes a stress for tensing the bonded portion between the inner wall and the outer wall and works so as to pull the outer wall toward the inner wall. That is, the casing of the present invention has an octangular inner wall. Therefore, as in FIG.3, the triangular space 24 between the outer wall and the inner wall, bulging of the inner wall due to the bulged inner bag is not conveyed to the outer wall, an inward force for attracting the outer wall to the inside is generated due to the internal pressure applied to the oblique surface (inner-cylinder forming piece 10) by using the both ends of the oblique surface as acting points, and thereby the load in the bulging direction of the side panel 2 or 3 is decreased.

Therefore, unlike the former one, the side panel is rarely bulged and bulging of the whole box can be reduced.

In the case of the present invention, because the casing and the inner cylinder are supported each other as described above, an outward pressure produced due to vibrations or shocks, or due to the rolling of a flowable product which is the content of an inner bag during transportation of the bag-in-box, an external force generated for disposal of goods, and a bending rigidity of a wall surface to a live load produced when bag-in-boxes are piled up to store them are improved and bulging or buckling decreases. Thus, the present invention shows a high compressive strength completely withstanding the predetermined number of stages of piled-up bag-in-boxes (they may be piled up to 12 to 15 stages, that is, a height of 4 m). According to the structure of the present invention, a container capable of withstanding a load of approx. 300 to 500 kg can be obtained.

Figure 10:
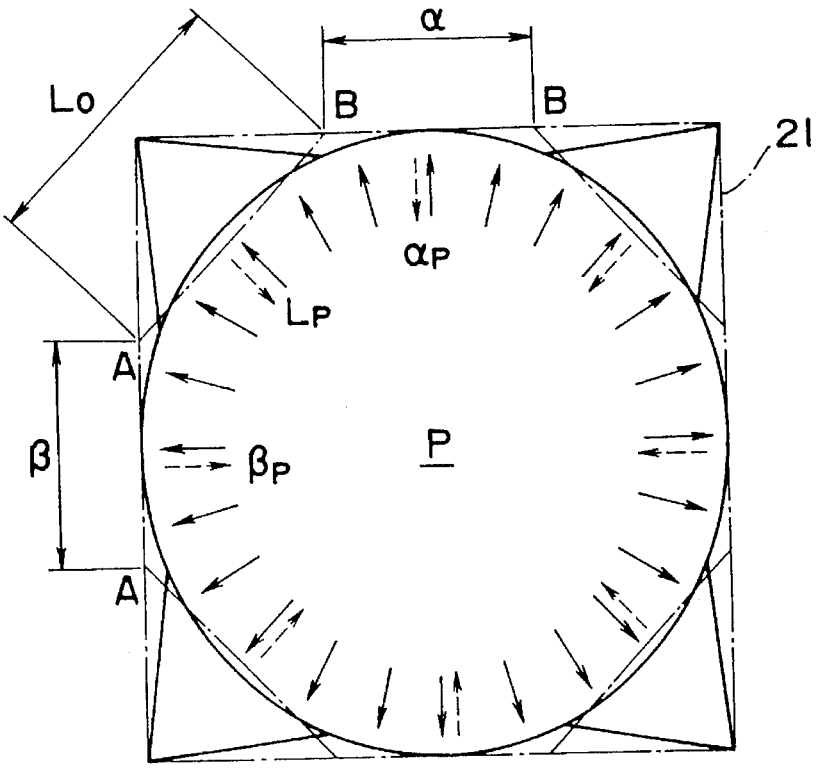
FIG. 10 is an illustration showing the relation between an oblique length L0 of the inner cylinder and the fixed surface length $\alpha$ or $\beta$ between the inner cylinder and the casing and the stress relation therebetween.

As shown in FIG. 10, when assuming an oblique length A-B of the octangular inner cylinder as L0 and the length of the fixed surface A—A or B—B between the inner cylinder and the casing as $\alpha$ or $\beta$ and setting these values so that the relation of L0 $>\alpha$ or $\beta$ is effected, or assuming the stress to internal pressure of the oblique surface of the octangular inner cylinder as Lp and the stress to internal pressure of the fixed surface between the inner cylinder and the side panel of the casing as $\alpha$ p or $\beta$ p and setting these values so that the relation of Lp$<\alpha$ p or $\beta$ p is effected, or forming a fold almost at the center of the oblique surface of the octangular inner cylinder in the direction of the inner cylinder depth, the internal pressure applied to the oblique surface (inner-cylinder forming piece 10) reduces the load of the side panel 2 or 3 in the bulging direction because an inward stress for attracting the outer wall to the inside is generated by using the both ends of the oblique surface as acting points.

Figure 11:
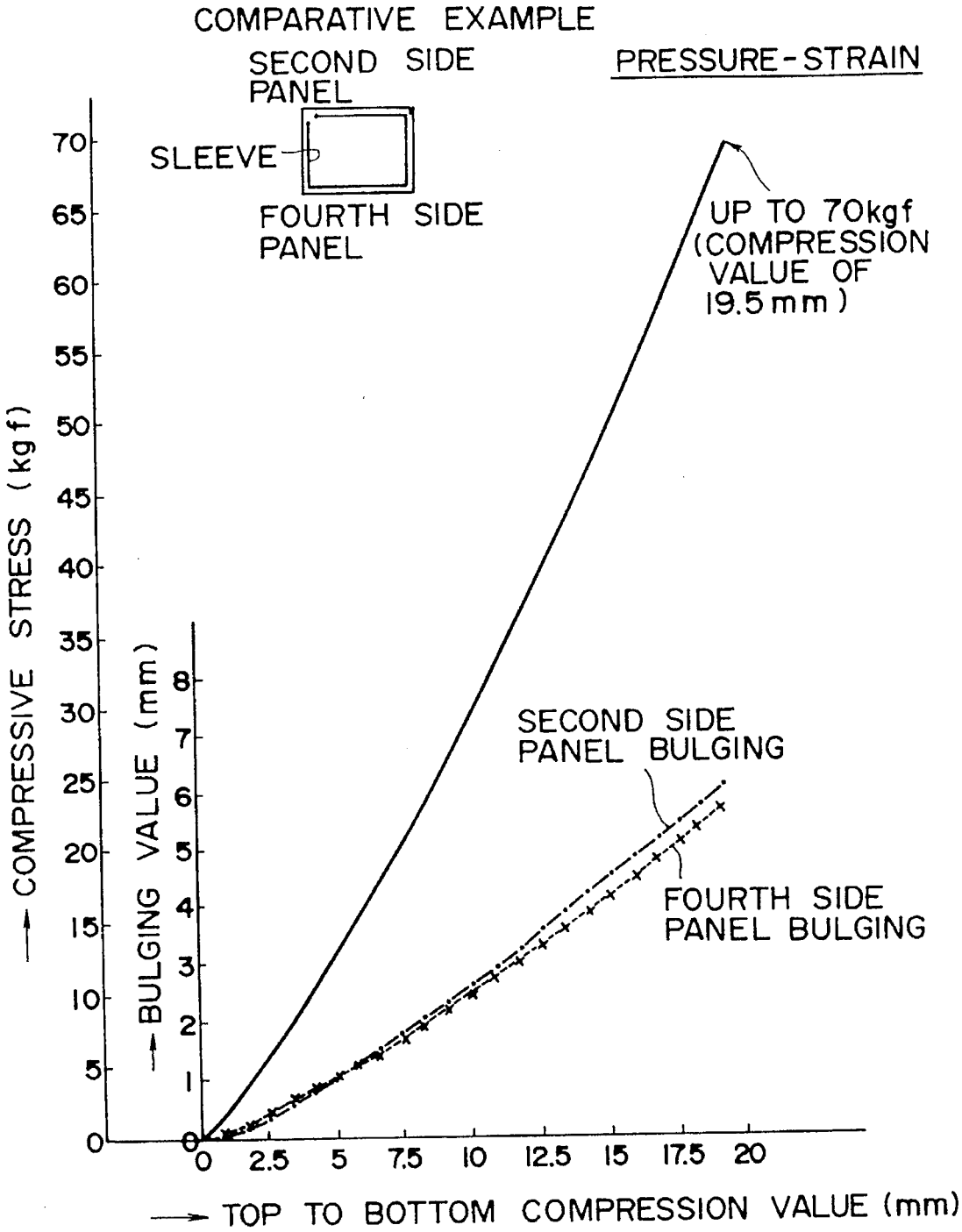
FIG. 11 is a diagram showing compressive stress, top to bottom compression value, and a side-panel bulging value of a container with a sleeve.
Figure 12:
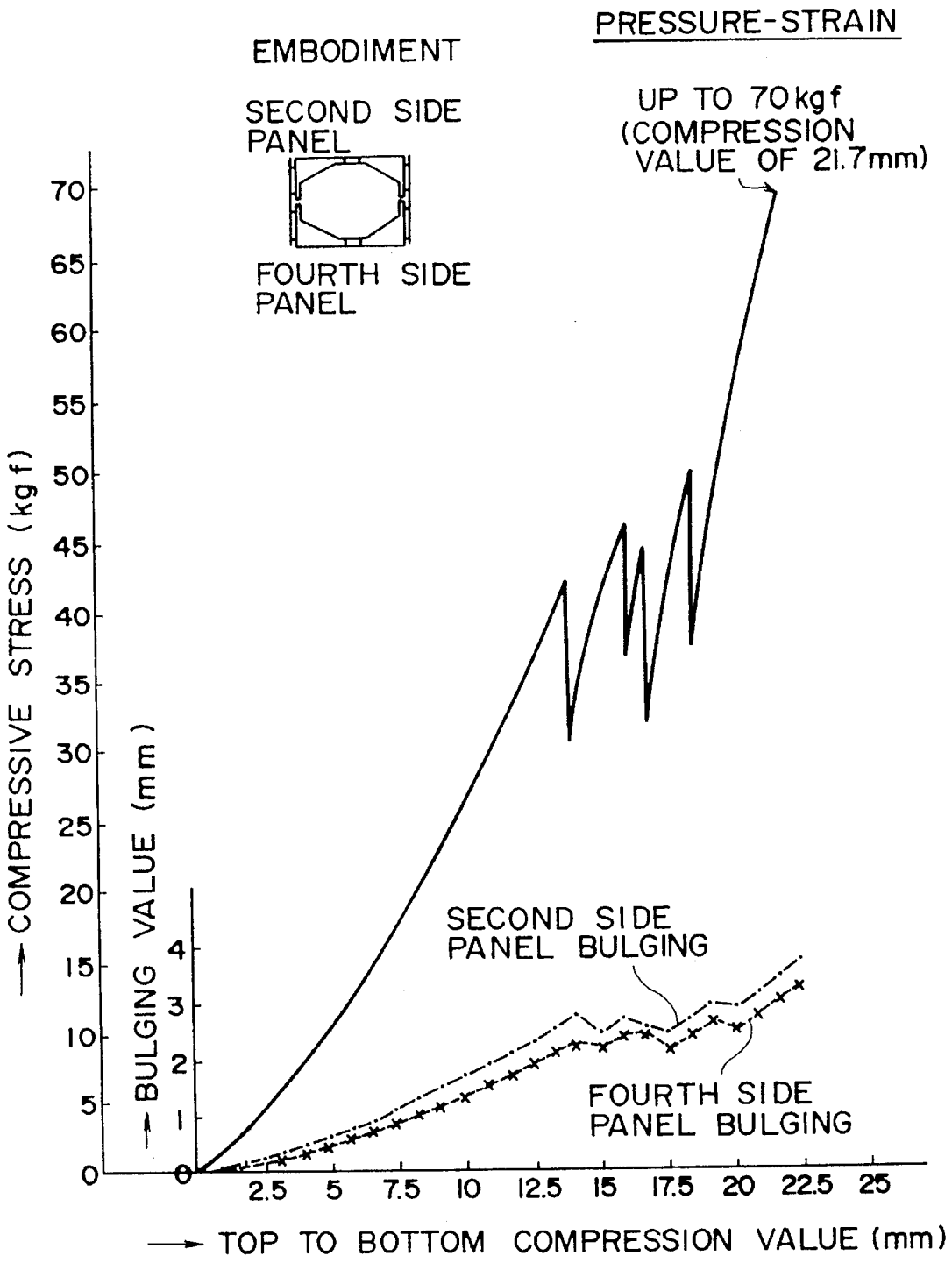
FIG. 12 is a diagram showing compressive stress, top to bottom compression value, and a side-panel bulging value of an embodiment of the present invention.
Figure 13:
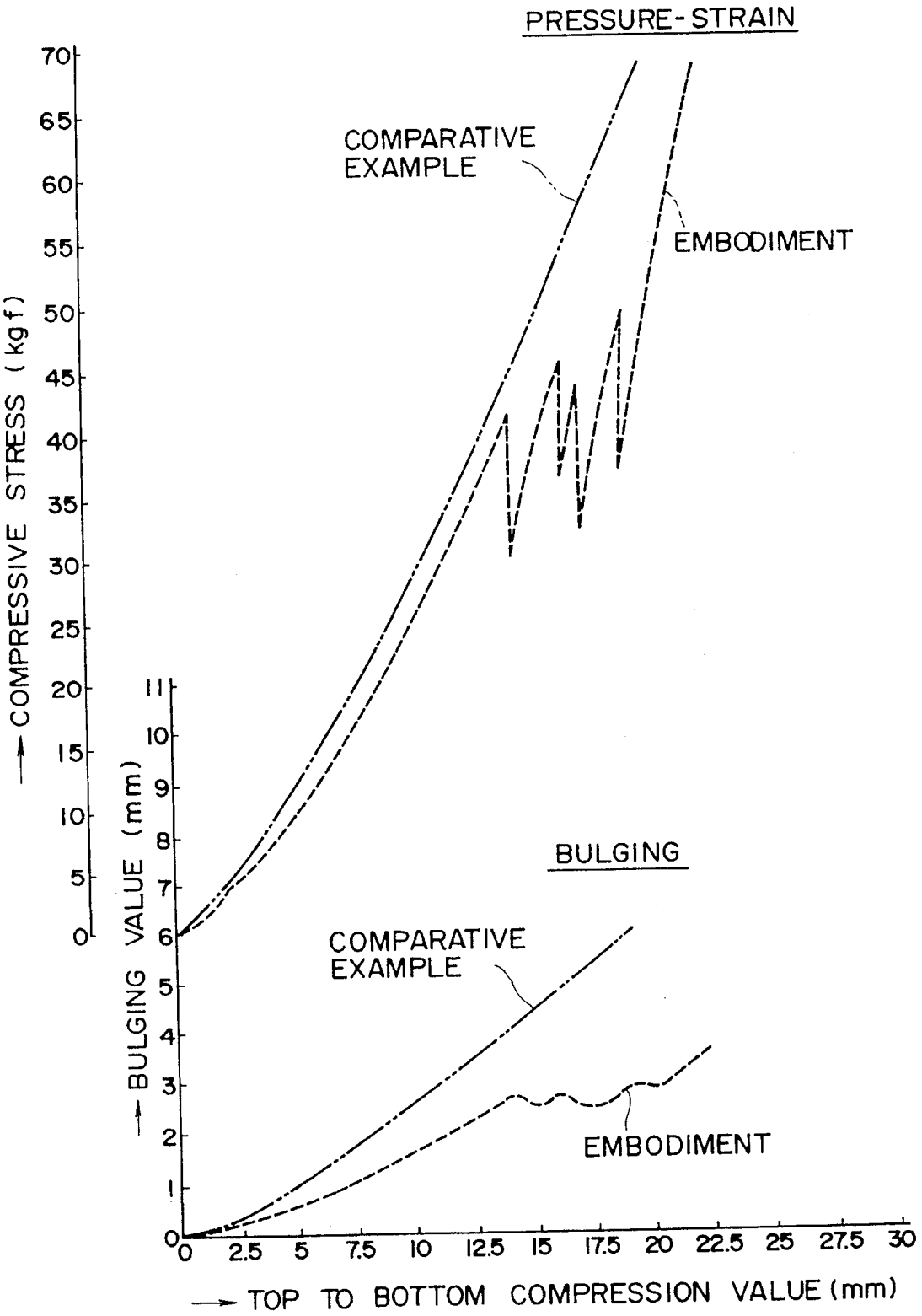
FIG. 13 shows stress-strain curves and bulging curves of an embodiment of the present invention and the container with the sleeve (comparative example)

The results of comparison of physical properties (internal pressure load test) of the bag-in-box of the present invention and an existing example (corrugated fiberboard box with a sleeve) in view of strength are shown in FIGS. 11 to 13 as a comparative example and an embodiment.

The method for testing the both is shown below.

An embodiment of the present invention in which an inner bag filled with water of 18 L is set in a casing made by using a sheet with the following constitution and having the structure shown in FIG. 2 and an existing example (comparative example) in which the inner bag filled with water of 18 L is set in a corrugated fiberboard box with a sleeve are used as test samples.

Figure 14:
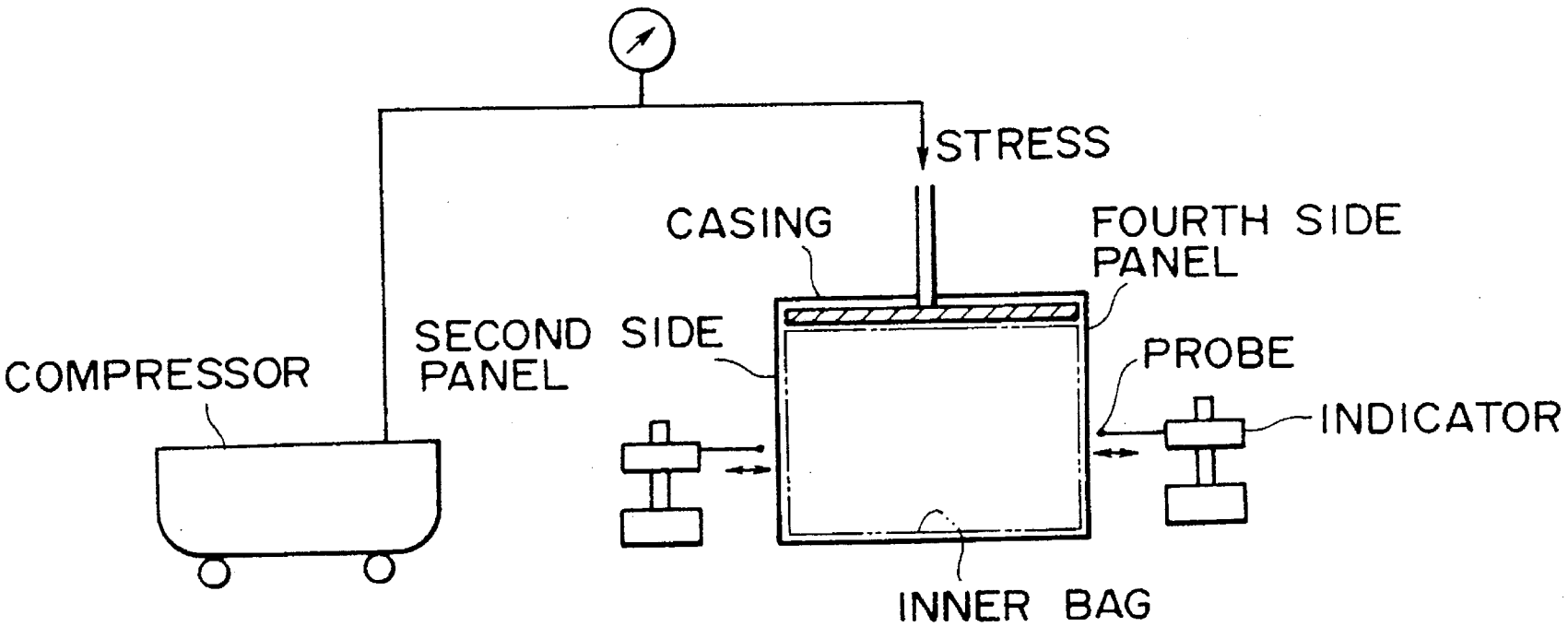
FIG. 14 is a schematic view of a laboratory equipment used for an internal pressure load test performed by using a comparative example (container with a sleeve) and an embodiment of the present invention as samples.
Figure 15:
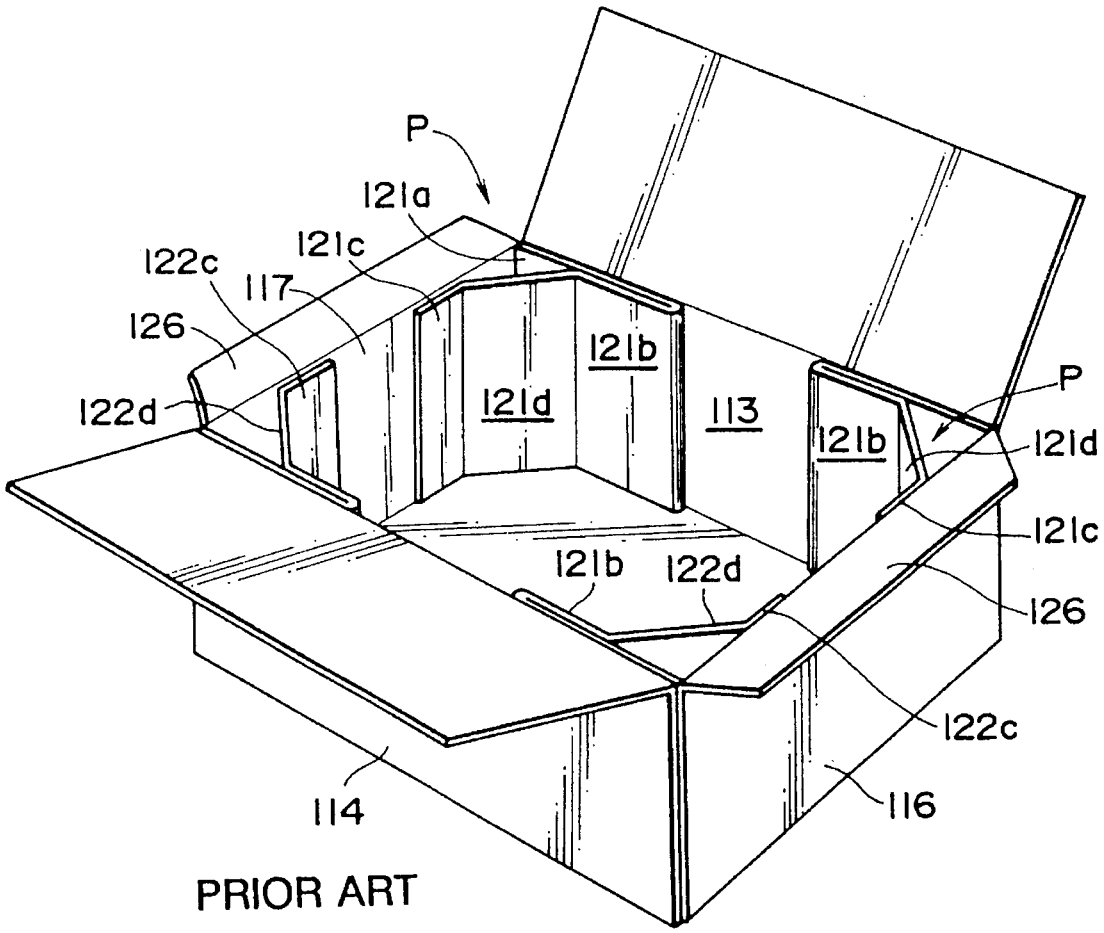
FIG. 15 shows a conventional corner-reinforced container.
Figure 16:
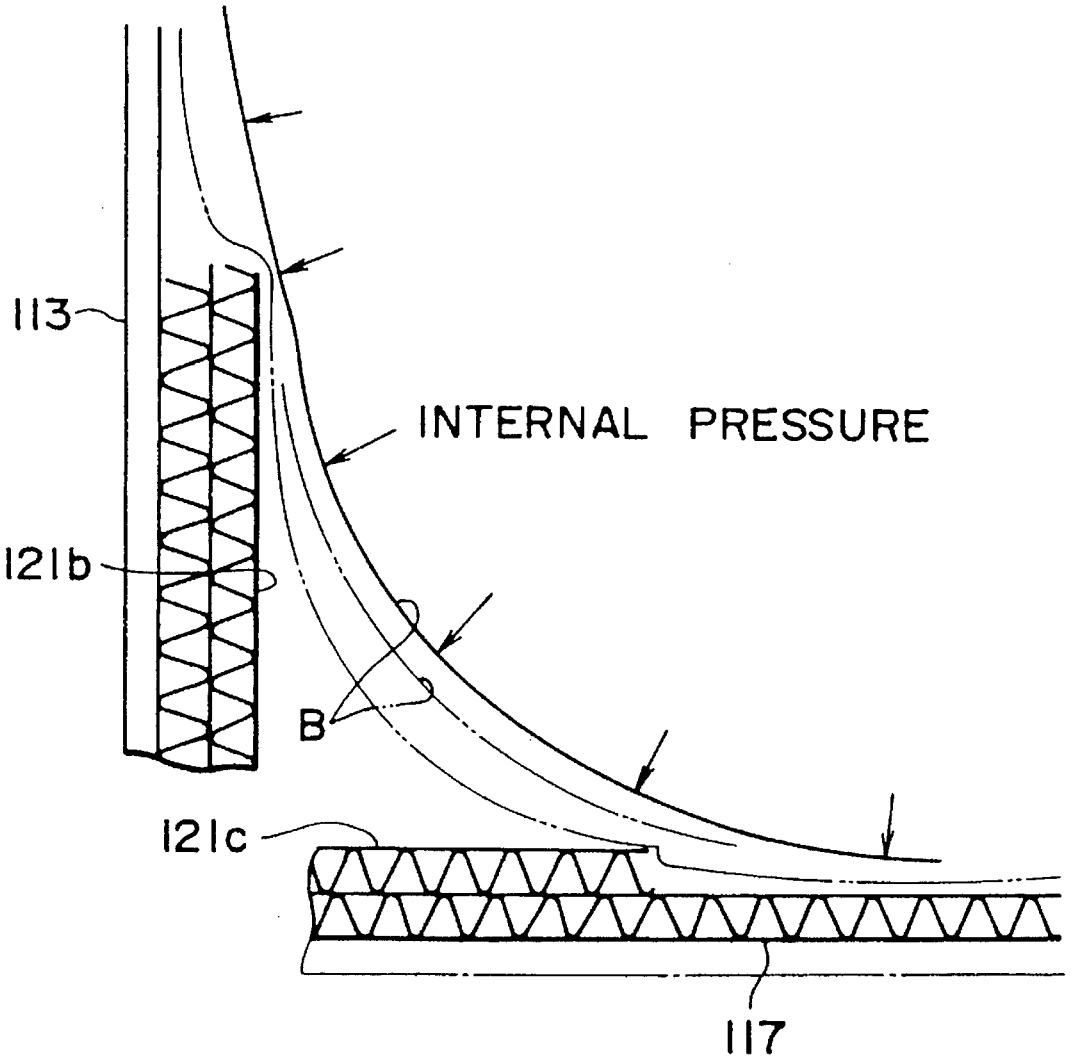
FIG. 16 is an illustration of a prior art bag showing that an inner bag made of flexible plastic is arranged in the container in FIG. 15.

The various parameters are as follows:

1. Constitution of sheet for corrugated fiberboard box K280/SCP160/K280/SCP160/K280: BA flute
2. Constitution of sheet for sleeve K280/SCP160/K280/SCP160/K280: BA flute
3. Box dimensions: 365 L×275 W×284 H The test method is as follows The top panel of the above samples is sealed and thereafter the pressure applied onto a pressure plate from a hole formed at the center of the pressure plate is slowly increased. In this case, the compressive stress, vertical compression value, and bulging value of a side panel are measured by using the laboratory equipment shown in FIG. 14.

Use of a TENSILON Model UCT made by A&D Inc.

Compressive strength: 10 mm/min

Full scale: 2.5 t

Displacement value of side panel (Bulged both sides: Second and fourth side panels)

Use of a MITUTOYO DIGIMATIC INDICATOR

Measurement is performed every 5 sec. (Use of a mini-processor)

A probe is set to a position 10 mm or less from ½ the outer dimension of a box.

Consideration (Evaluation)

FIG. 11 shows a stress-strain curve and bulging curves obtained by compressing the box of the existing example. The bulging value differs in the second side panel and the fourth side panel of the box because the position of the butting portion of a sleeve (made by folding one sheet into a cylinder) varies. As the result of joining the butting portions by a tape, the difference of bulging between the both panels decreases but the bulging value is not decreased.

FIG. 12 shows a stress-strain curve and bulging curves obtained by compressing the box of the embodiment. From FIG. 12, in the case of the embodiment of the present invention, it is found that the bulging of the inner wall due to the bulged inner bag is hardly conveyed to the outer wall at first. When the pressure is further slowly increased and reaches 40 kg, it is recognized that the pressure greatly fluctuates four times. In this case, the bulging value decreases. This shows that an oblique side of the octangular inner cylinder is folded outward and deformed and at the same time, the second and fourth side panels are pulled inward.

FIG. 13 shows comparison of stress-strain curves and bulging values of the comparative example and the embodiment. The bulging value uses the average value of the bulging values of the second and fourth side panels for both the comparative example and the embodiment.

In the case of the embodiment, it is found from FIGS. 11 to 13 that, when the oblique side of the octangular inner cylinder set in the box is deformed outward, the load applied to the oblique side works so as to attract the outer wall inward because a stress for tensing the bonded portion between the inner and outer walls is generated, that is, an inward component force pulls the lateral of the box inward by using the both ends of the oblique side as acting points to reduce the bulging-directional lead of the side panel 2 or 3 to be easily bulged and decreases the bulging value of the whole box compared to the existing container with a sleeve.

The assignee company (KIKKOMAN CORP.) has continued a piling test by actually pouring soy sauce (specific gravity of 1.17) of 10 lit into the above embodiment of the present invention and an existing example respectively to confirm the state under a high humidity in the rainy season since May 20, 1994. The test has been performed under the following condition. In the case of the existing example, a four-stage piling pallet is piled up to two stages, that is, a total of 8 pallets are piled up to measure the bulging value of a side panel of the container at the bottom stage. In the case of the embodiment of the present invention, a five-stage piling pallet is piled up to three stages, that is, a total of 15 stages are piled up to measure the bulging value of the side panel of the container at the bottom stage.

As the result of measurement on June 20, a bulging value of 3 mm was measured for the embodiment of the present invention and a bulging value of 11 mm was measured for the existing example. It was characteristic that a humidity of 90% RH was recorded between June 12 and June 14 (three days) and bulging was confirmed for the existing example but bulging was hardly recognized for the embodiment of the present invention though the number of stages for the embodiment of the present invention was two times larger than the number of stages for the existing example. Moreover, the assignee company (KIKKOMAN CORP.) performed a truck transportation test for the embodiment of the present invention by reciprocating a truck on which a pallet containing soy sauce of 10 lit was piled up to five stages and a pallet containing soy sauce of 18 lit was piled up to 4 stages on a general road of 70 km between Noda and Yachimata in Chiba Prefecture four times up to 560 km. As a result, however, no trouble was recognized.

The bag-in-box of the present invention has not only the above advantage for anti-bulging but also the following useful advantages.

That is, because the casing of the present invention is formed with one corrugated fiberboard sheet, it can easily be manufactured and the manufacturing cost and the distribution cost are decreased compared to a casing formed by combining a plurality of materials.

In the case of an octangular inner cylinder set in a casing, ends of the forming pieces 8 and 8 are butted each other in the side panel 2 and ends of the adjacent forming pieces 11 and 11 are butted each other in the side panel 3. Therefore, because no stepped portion is produced on the surface where the inner bag 22 contacts the inner cylinder 20, it does not occur that the inner bag is broken due to contact of the inner bag with a cut end of a material forming the inner cylinder when the inner bag is set in the inner cylinder.

Moreover, because the air vent hole 25 is formed at the bottom of the oblique surface of the octangular inner cylinder, it is possible to securely release air from the box when the inner bag is inserted into the octangular inner cylinder and smoothly insert the inner bag up to the bottom of the box. Therefore, after the bag is inserted, it is possible to immediately seal the top panel of the casing. Moreover, to package a product, it is possible to decrease the dimensions of the box because the space volume other than the bag does not excessively increase.

Furthermore, because an inner bag made of flexible plastic is set in the octangular inner cylinder, the content liquid is easily discharged without leaving residue inside.

A hand hole is formed on the outer wall of the triangular space 24 formed between the casing 21 and the inner cylinder 20 at the diagonal position of the casing 21, that is, on the faced side panels 3 and 3. When the hand hole is formed at the above position, there are advantages that not only the hand hole does not deteriorate the anti-bulging function but also it prevents foreign matter such as dust from entering the inner cylinder from the outside through the hole.

Figure 6:
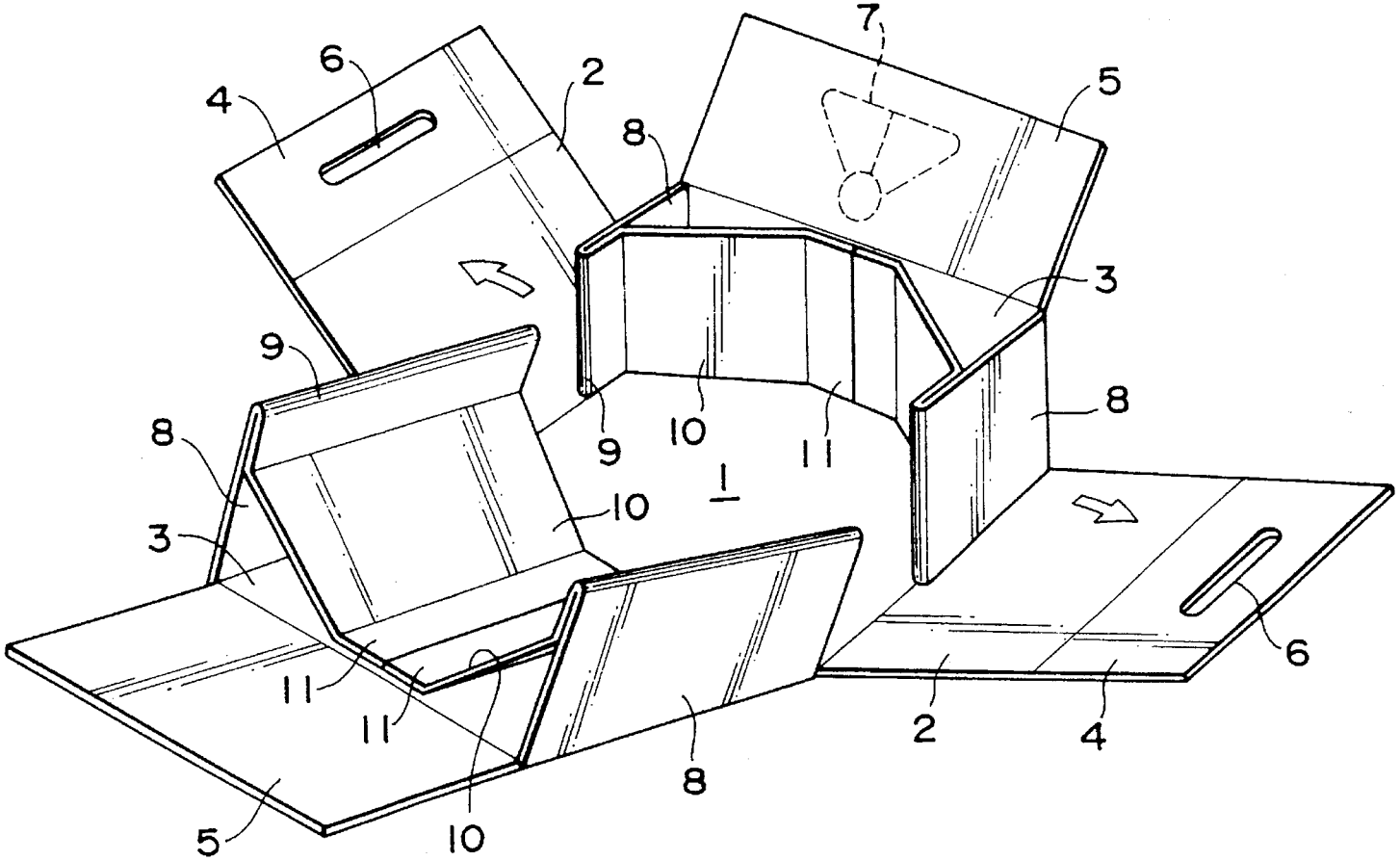
FIG. 6 is a perspective view showing the state in which the casing is being disassembled.

FIG. 6 shows the state in which the casing of the present invention is being disassembled. As shown in FIG. 6, because the inner bag is separated from the casing and they are recollected after use, the joined surface between the casing and the inner cylinder can easily be disassembled by putting hands on the disassembling hand hole 6 and the takeout hole 7 of the pouring hole formed on the flaps 4 and 5 and pulling the faced side panels 2 and 2 outward when it is necessary to disassemble the casing. Therefore, because it is possible to easily flatten the casing of the present and recollect it, there are excellent advantages that the casing can easily be disposed and no large space is necessary.

What is claimed is:

1. A packaging container with anti-bulging function comprising:

a bag made of a flexible material;

a box;

said bag inside a said box;

said box being made of a one piece blank;

said one piece blank being made of a corrugated-fiberboard or a paperboard sheet;

said one piece blank further has a rectangular bottom plate, two pairs of faced side panels with a plurality of top edges, a quadrangular cylindrical casing with a lid extending to each of said plurality of top edges of said two pairs of side panels, and an inner cylinder with a substantially octangular cross section, wherein said two pairs of faced side panels are erected at four sides of said bottom plate;

said octangular cylinder is formed with four inner-cylinder forming pieces extending to both sides of one pair of said two pairs of side panels:

said inner-cylinder forming pieces are formed into said octangular cylinder by folding to the inside of the casing through ruled limes drawn between said inner-cylinder forming piece; and said bag having dimensions larger than the inside diameter of said octangular cylinder is arranged inside said inner cylinder.

2. A packaging container with anti-bulging function, comprising a bag inside a box according to claim 1, wherein the relation of $LO>\alpha$ or $\beta$ is effected when an oblique length of the octangular inner cylinder is set as LO and the length of the fixed surface between the inner cylinder and the side panel of the casing is set as $\alpha$ or $\beta$.

3. A packaging container with anti-bulging function, comprising a bag inside a box according to claim 1, wherein the relation of $Lp<\alpha\ p$ or $\beta\ p$ is effected when, Lp is set as the stress to internal pressure of an oblique surface of the octangular inner cylinder, and the $\alpha\ p$ or $\beta\ p$ is set as the stress to internal pressure of the fixed surface between the inner cylinder and a side panel of the casing.

4. A packaging container with anti-bulging function, comprising a bag inside a box according to claim 1 wherein a fold is formed at the approximate center of an oblique surface of the octangular inner cylinder in the direction of the inner cylinder depth.

5. A packaging container with anti-bulging function, comprising a bag inside a box according to claim 1 wherein the ends of said forming pieces are butted against each other so that a gap or stepped portion is not produced between the ends of said inner cylinder forming pieces arranged so as to adjoin each other.

6. A packaging container with anti-bulging function, comprising a bag inside a box according to claim 1 wherein a hand hole is formed on a side panel of the casing at the outside of a triangular space formed between the casing and the inner cylinder.

7. A packaging container with anti-bulging function, comprising a bag inside a box according to claim 1 wherein a disassembly hand hole is formed on any one pair of lids.

8. A packaging container with anti-bulging function, comprising a bag inside a box according to claim 1, wherein an air vent hole is formed at the bottom of an oblique surface of the octangular inner cylinder.

9. A packaging container with anti-bulging function, comprising a bag inside a box according to claim 1, wherein a circuitarc recess for concentrating the holding stress for folding is formed at both ends of an inner-cylinder fold piece up to 180 deg.

10. A packaging container with anti-bulging function comprising:

a box;

a thin-walled container;

said thin-walled container inside said box;

said box being made of a one piece blank;

said one piece blank being made of a corrugated-fiberboard or a paperboard sheet;

said one piece blank further has a rectangular bottom plate, two pairs of faced side panels with a plurality of top edges, a quadrangular cylindrical casing with a lid extending to each of said plurality of top edges of said two pairs of side panels, and an inner cylinder with a substantially octangular cross section, wherein said two pairs of faced side panels are erected at four sides of said bottom plate;

said octangular cylinder is formed with four inner-cylinder forming pieces extending to both sides of one pair of said two pairs of side panels:

said inner-cylinder forming pieces are formed into said octangular cylinder by folding to the inside of the casing through ruled limes drawn between said inner-cylinder forming pieces; and said thin-walled container having dimensions larger than the inside diameter of said octangular cylinder is arranged inside said inner cylinder.

11. A packaging container with anti-bulging function according to claim 10 wherein the relation of $LO>\alpha$ or $\beta$ is effected when an oblique length of said octangular inner cylinder is set as LO and the length of the fixed surface between said inner cylinder and said side panel of said casing is set as $\alpha$ or $\beta$.

12. A packaging container with anti-bulging function according to claim 10 wherein the relation of $L_p<\alpha p$ or $\beta p$ is effected when, $L_p$ is set as the stress to internal pressure of an oblique surface of said octanhilatr inner cylinder, and said $\alpha p$ or $\beta p$ is set as the strss to internal pressure of the fixed surface between said inner cylinder and said side panel of said casing.

13. A packaging container with anti-bulging function according to claim 10 wherein a fold is formed at the substantial center of an oblique surface of said octangular inner cylinder in the direction of said inner cylinder depth.

14. A packaging container with anti-bulging function according to claim 10 wherein the ends of said forming pieces are butted against each other so that a gap or stepped portion is not produced between said ends of said inner cylinder forming pieces arranged so as to adjoin each other.

15. A packaging container with anti-bulging function according to claim 10 wherein a hand hole is formed on a side panel of said casing at the outside of a triangular space formed between said casing and said inner cylinder.

16. A packaging container with anti-bulging function according to claim 10 wherein a disassembly hand hole is formed on any one pair of lids.

17. A packaging container with anti-bulging function according to claim 10 wherein an air vent hole is formed at the bottom of an oblique surface of said octangular inner cylinder.

18. A packaging container with anti-bulging function according to claim 10 wherein a circuitarc recess for concentrating the holding strss for folding is formed at both ends of an inner-cylinder fold piece up to 180 deg.

* * * * *

UNITED STATES PATENT AND TRADEMARK OFFICE

CERTIFICATE OF CORRECTION

PATENT NO. : 5,562,227

DATED : October 8, 1996

INVENTOR(S) : Taihei TAKEZAWA, Hyozaemon TAKANASHI, Nobuo SUGIMARU, Shoichi KAWASE, Yutaka WATANABE, Mitsuo TAKAYANAGI, and Kinzaburo AKITA

It is certified that errors appears in the above-identified patent and that said Letters Patent is hereby corrected as shown below:

| | | | | |
|---|---|---|---|---|
| Claim 9, | **Column 11,** | Line 28, | Change **circuitarc** | to **circular-arc** |
| Claim 10, | **Column 12,** | Line 6, | Change **limes** | to **lines** |
| Claim 12, | **Column 12,** | Line 19, | Change **octanhilatr** | to **octangular** |
| Claim 12, | **Column 12,** | Line 20, | Change **strss** | to **stress** |
| Claim 18, | **Column 12,** | Line 43, | Change **circuitarc** | to **circular-arc** |
| Claim 18, | **Column 12,** | Line 44, | Change **strss** | to **stress** |

Signed and Sealed this

Twenty-first Day of October 1997

*Attest:*

*Attesting Officer*

BRUCE LEHMAN

*Commissioner of Patents and Trademarks*